United States Patent [19]

Vanago

[11] Patent Number: 4,621,845

[45] Date of Patent: Nov. 11, 1986

[54] INTEGRAL PERIPHERAL LOCKING DEVICE FOR CLOSURES

[76] Inventor: Joseph Vanago, 1, rue des Chaux Villefranche-le-Haut, Lyon, France, F-69340

[21] Appl. No.: 616,226

[22] PCT Filed: Sep. 20, 1983

[86] PCT No.: PCT/FR83/00186

§ 371 Date: May 14, 1984

§ 102(e) Date: May 14, 1984

[87] PCT Pub. No.: WO84/01181

PCT Pub. Date: Mar. 29, 1984

[30] Foreign Application Priority Data

Sep. 21, 1982 [FR] France ..... 82 16073

[51] Int. Cl.[4] ..... E05C 9/04; E05C 9/14

[52] U.S. Cl. ..... 292/37; 70/120; 109/59 R; 292/140

[58] Field of Search ..... 70/118–120; 109/59, 58.5, 61, 63.5; 292/32–43

[56] References Cited

U.S. PATENT DOCUMENTS

| | | | |
|---|---|---|---|
| 16,874 | 3/1867 | Foster et al. . | |
| 85,617 | 1/1869 | Simons | 292/37 X |
| 141,874 | 8/1873 | Hall | 292/40 |
| 165,752 | 7/1875 | Naylor et al. | 292/40 X |
| 831,036 | 9/1906 | Caley | 292/37 |
| 914,424 | 3/1909 | Kelly | 292/36 |
| 1,125,626 | 1/1915 | Young et al. | 292/37 |
| 1,269,572 | 6/1918 | Allenbaugh | 292/37 |
| 1,909,697 | 5/1933 | MacBeth et al. | 292/40 X |
| 2,473,065 | 6/1949 | Miller . | |
| 2,550,040 | 4/1951 | Clar | 292/43 X |
| 2,610,368 | 9/1952 | Tschaepe . | |
| 3,711,139 | 1/1973 | Polk | 292/140 X |
| 4,114,933 | 9/1978 | Jankelwitz et al. | 292/37 |

FOREIGN PATENT DOCUMENTS

| | | | |
|---|---|---|---|
| 731161 | 9/1969 | Belgium . | |
| 1318783 | 1/1963 | France . | |
| 536425 | 6/1973 | Switzerland . | |
| 29067 | of 1898 | United Kingdom . | |
| 21302 | of 1908 | United Kingdom | 70/120 |
| 149569 | 8/1920 | United Kingdom . | |
| 1192236 | 5/1970 | United Kingdom . | |

*Primary Examiner*—Robert L. Wolfe
*Assistant Examiner*—Russell W. Illich
*Attorney, Agent, or Firm*—Sandler & Greenblum

[57] ABSTRACT

A locking device for a door. The device includes at least one locking element movably mounted on the door. The door is locked by extending each locking element along one diagonal line of the door until the outer edge of the element enters into a recess in adjacent sides of the door frame. The door is unlocked by retracting each locking element along the diagonal line to the point where the outer edge of the element has exited from the recess and the inner edge is resting on the other diagonal line of the door.

10 Claims, 9 Drawing Figures

INTEGRAL PERIPHERAL LOCKING DEVICE FOR CLOSURES

BACKGROUND OF THE INVENTION

1. Field of the Invention

This invention concerns an integral peripheral locking device for closures comprising one or more longitudinal members situated on at least one of the sides of the closures and actuated by a translational movement to penetrate the corresponding housings in fixed frames. It is suitable for use in closures, such as doors, including doors with two leaves. It may be employed with shutters, safety vaults, safes, motor vans, trucks, or railway cars.

2. Description of the Material Information

United Kingdom No. 29,067 describes a door locking device which comprises two bars or plates adapted to be actuated by a to and fro movement to enter into and come out of corresponding recesses made in the door frame when actuated by a key lock.

U.S. Pat. No. 2,610,368 describes a closing mechanism for a two-leaf door. A bar, mounted vertically in the free edge of the first leaf and extending approximately the whole height of the leaves, can be actuated by a sliding movement to penetrate into a corresponding groove in the second leaf, when operated by a barrel lock key. The patent France No. 1,318,783 describes a safety device for locking doors which fundamentally comprises a sliding flat iron fitted on the edge of the door and a slotted head fastened on the frame, the said flat iron being capable of engaging in the slot to lock the door over the whole of its height. U.S. Ser. No. 16,874 discloses a vertical bar mounted in the free edge of the door, extending approximately the whole height of the door, actuated by a lock which, to lock the door, houses itself in a slot provided in the frame of the said door.

These locking systems reveal weak points, especially at the top of the frame and at floor level. Consequently, they do not offer absolute security against break-in. In another respect, these systems are complicated because they comprise several bars which must be interlinked and simultaneously controlled by complex operating and guiding components.

SUMMARY OF THE INVENTION

The invention provides secure integral peripheral locking for a closure by means of a simple, practical and rational device compressing of approximately the same dimensions as the closure, sandwiched between the faces of the closure and cut along one diagonal to form two equal and opposed triangles placed edge to edge. The two triangles are capable of moving apart from one another in the direction of the other diagonal so as to project peripherally and engage in corresponding slots provided in the fixed frame and in the threshold, their translation movement being guided and controlled by suitable means.

The means of guiding the two triangles are ball bearing tracks directed in the axis of movement of each triangle. The two faces of the closure are joined through perforations or cut-outs in the triangles, thereby lightening the assembly.

A means of control for extending and retracting the two triangles comprises a cam, which may be a circular disk-shaped cam. Each face the cam is grooved with a spiral slot in which a finger integral with one of the two triangles is engaged, such that rotation of the disc by one complete revolution brings about the radial movement of the fingers and consequently that of the triangles with which they are integral.

A first means of driving the cam controlling the two triangles comprises a handwheel keyed to the cam by means of a shaft. This handwheel which can be located on the inner side of the closure, directly operates the closure locking device.

A second means of driving the cam controlling the two triangles comprises a handwheel, a lock, and a dog clutch. The lock is mounted on the handwheel, and is operably associated with the dog clutch. The dog clutch is meshable with the cam. A key inserted in the lock engages the dog clutch. Rotation of the key causes the dog clutch to mesh with the cam, thereby joining the handwheel to the cam and permitting the rotation of the cam. The handwheel and key opening for the lock in this second means can be located on the outer side of the closure.

This locking devices provides closures with properties of firebreaking, soundproofing, and thermal insulation. This locking device can be used with closures covering extensive areas, particularly since the sides of the triangles engaging in the slots can be reinforced by folding the edges of the triangles back on themselves at the level of the projecting parts.

In the text which follows, the invention is explained more in detail by means of drawings representing one embodiment only.

DETAILED DESCRIPTION OF THE PREFERRED EMBODIMENTS

Figure 1:
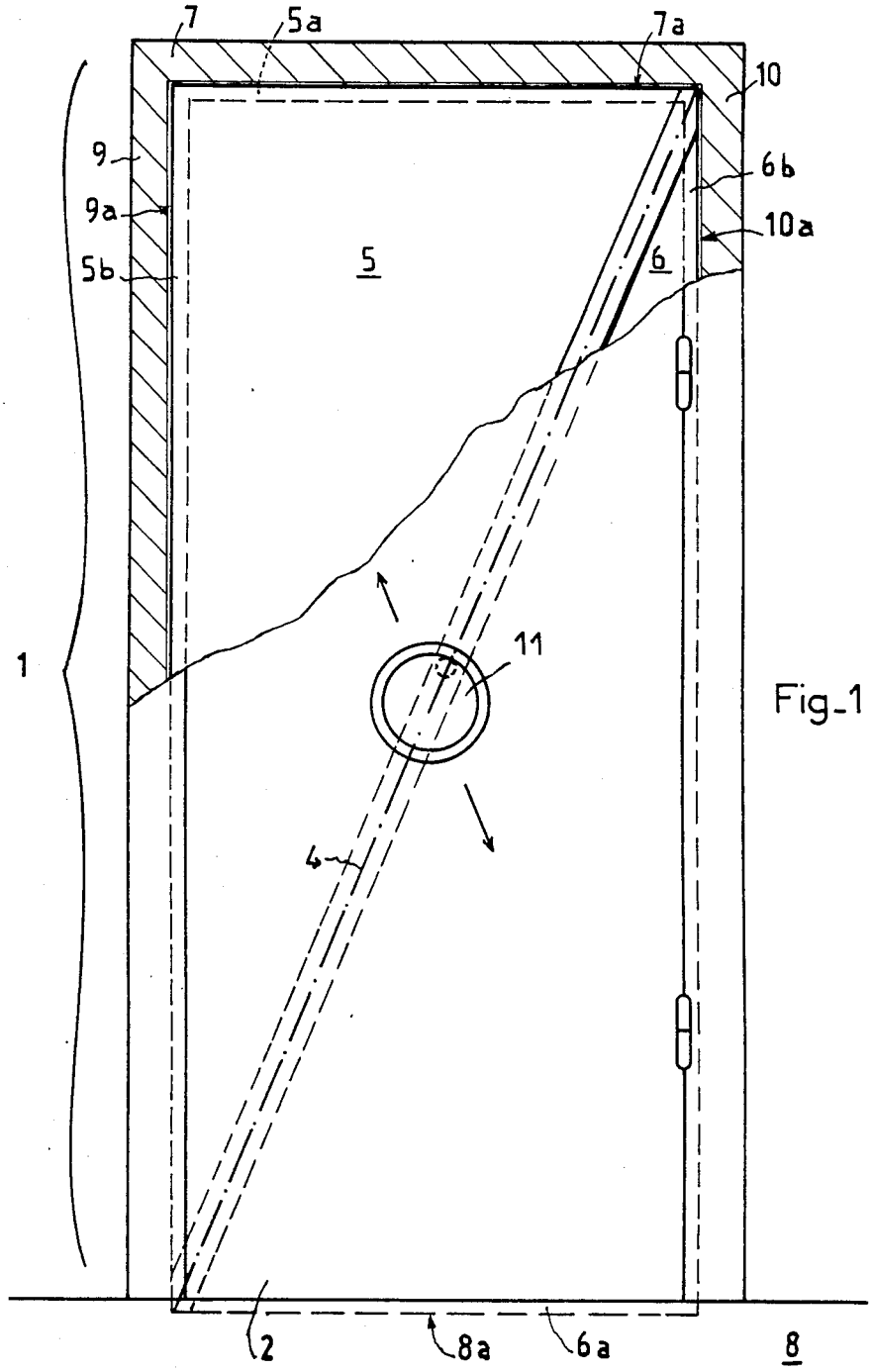
FIG. 1 is a view in elevation of a closure according to the invention, shown in position and locked.
Figure 2:
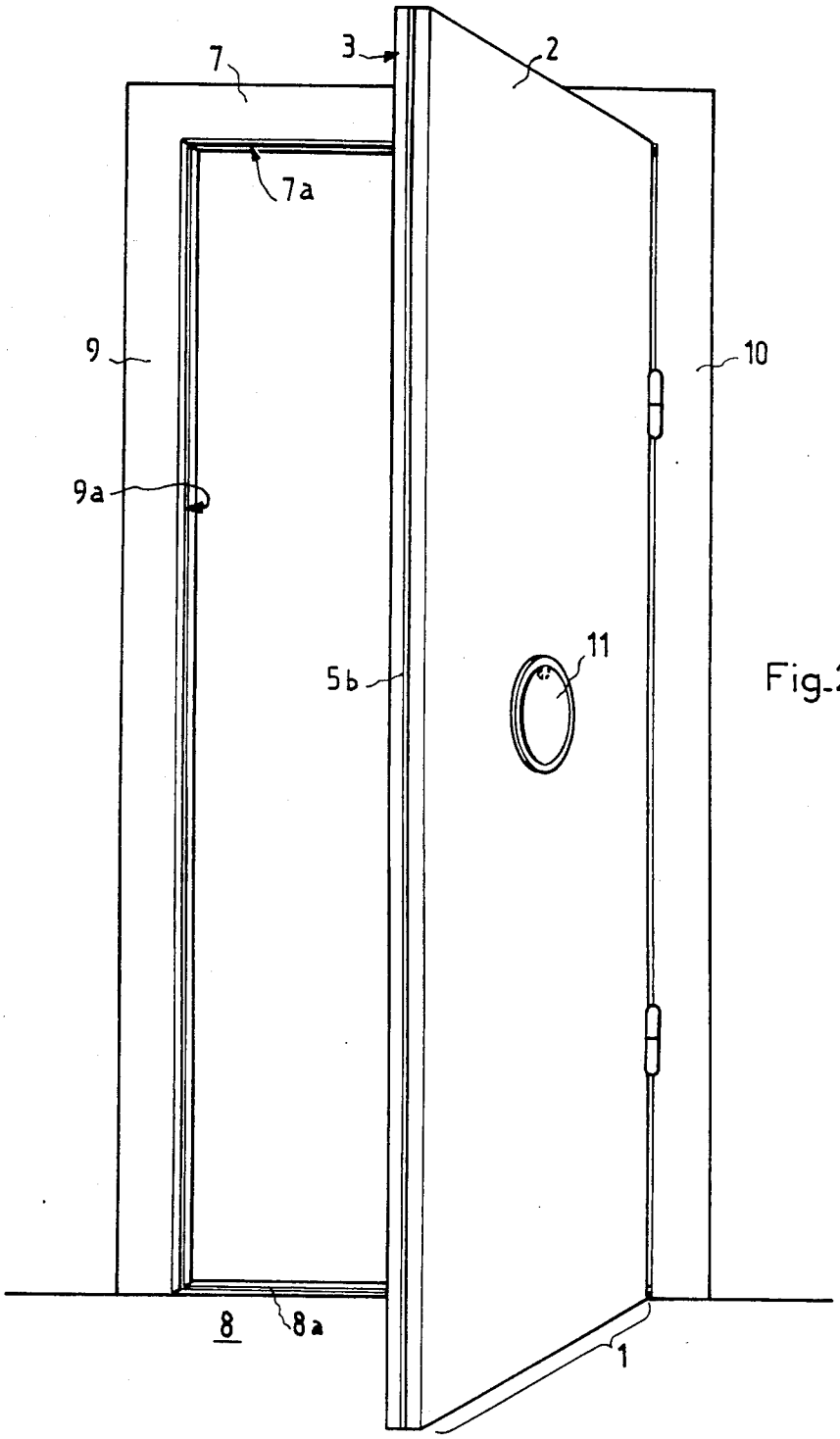
FIG. 2 is a view of the preceding closure, in the open position.

Closure 1 represented in FIGS. 1 to 5 is made up of two conventional panels 2 and 3 holding between them a plate of approximately the same size. The plate is made of metal, alloy or any other material and is, cut along diagonal 4 to form two equal, opposed triangles 5 and 6 placed edge to edge. These two triangles are capable of moving apart from one another in the direction of the other diagonal between the closure panels in such a manner that horizontal sides 5*a* and 6*a*, and vertical sides 5*b* and 6*b*, respectively, enter into corresponding slots grooved in frame and in threshold 8 of opening, in particular 7*a* in the top rail 7, 9*a* in stile 9, 10*a* in stile 10 and 8*a* in the threshold 8.

In the center of door 1 is represented operating means 11 one embodiment of the locking means for operating triangles 5 and 6.

Figure 4:
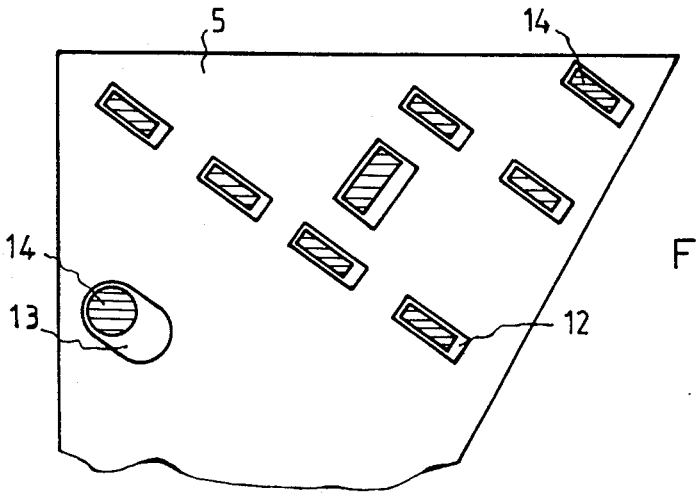
FIGS. 4 and 5 show, in elevation and in plan, respectively, the method of joining together the members comprising the closure.
Figure 5:
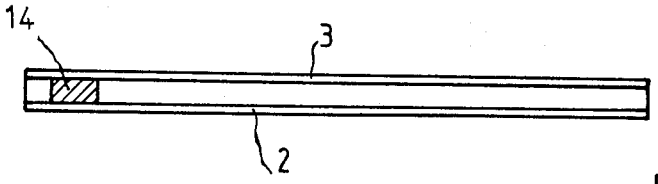

Referring to FIGS. 4 and 5, it can be seen that each of triangles 5 and 6 has at least one rectangular aperture 12 and/or at least one oblong aperture 13 to house the cleats 14 joining together panels 2 and 3 of the door 1. Operating means mechanical unit 11 occupying center of the closure controls the moving apart and the bringing together of the triangles 5 and 6, an operation which can only be carried out when the door is in the closed position in the casing frame.

Figure 3:
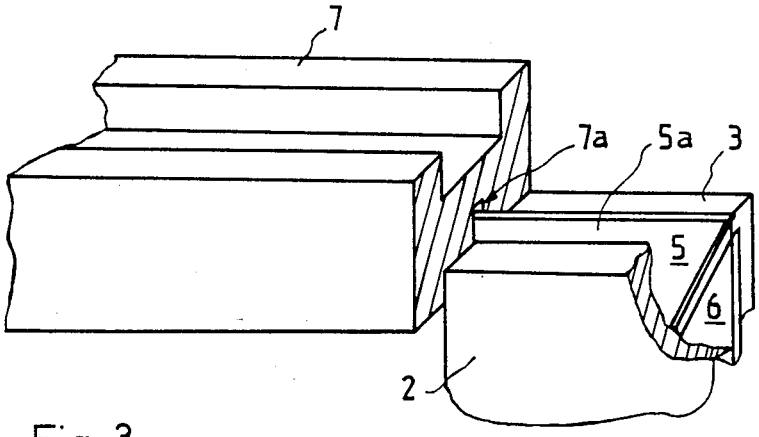
FIG. 3 is in detail view, a partial section, showing a corner of the closure closed and locked in the frame slot.

The movement of the triangles 5 and 6 is guided by ball bearing tracks, not shown in the figures, set in openings directed along the axis of movement of the triangles. Edges 5*a* and 6*a* penetrate into slots 7*a* and 8*a*, respectively, and edges 5*b* and 6*b* house themselves in slots 9*a* and 10*a* respectively. FIG. 3 shows locking of the door by horizontal side 5*a* of triangle 5, which penetrates into slot 7*a* of top rail 7 of the frame.

Figure 6:
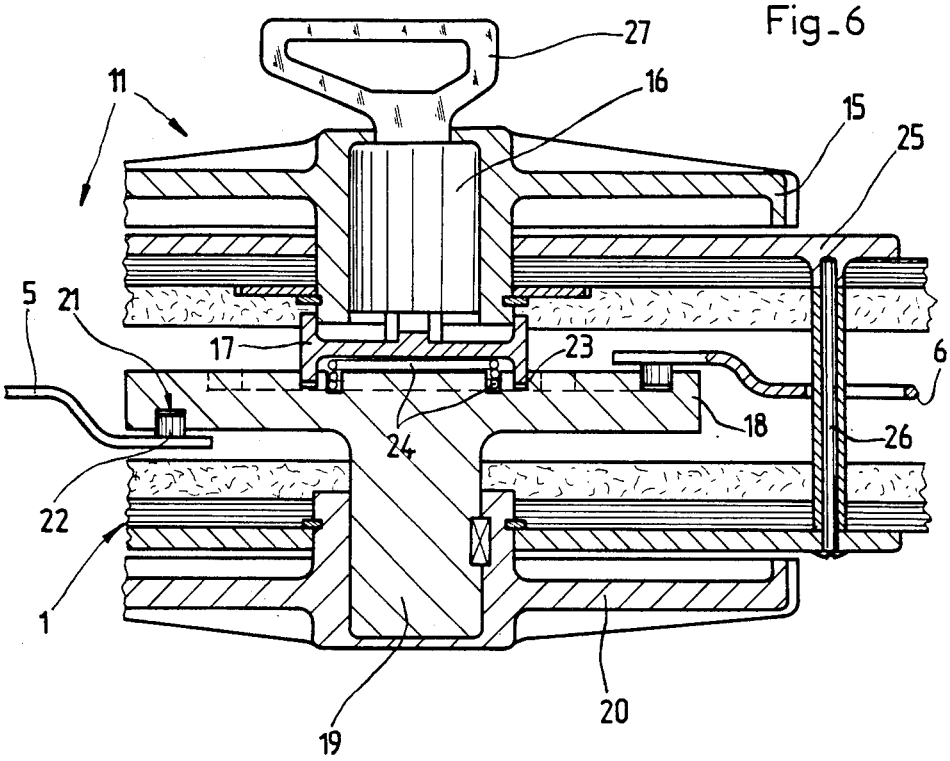
FIG. 6 represents, in section and in elevation, a means of operating the locking triangles.
Figure 7:
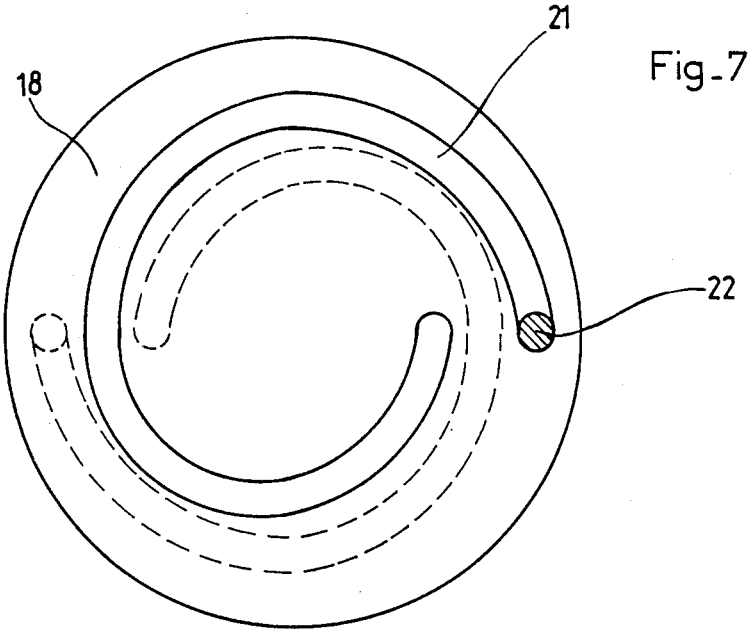
FIG. 7 shows the detail, in face view, of the triangle control cam.

For translation operation of the locking triangles 5 and 6, one embodiment of operating means 11 is illustrated by FIGS. 6 and 7. It comprises handwheel 15 located on the outer face of the door and equipped with central lock 16, a barrel lock for example, which causes dog clutch 17 to mesh with circular disk-shaped cam 18. Cam 18 is extended by shaft 19, on which is keyed handwheel 20 located on the inner face of door or closure 1.

Each internal face of cam 18 is grooved with Archimedes' spiral 21, one of which can be seen in FIG. 7, in which finger 22, integral with triangle 5 or 6 engages.

A dog clutch is a machinery clutch in which projections of one element fit into recesses in the other. In particular, as shown in FIG. 6, the projections or flanges 23 of dog clutch 17, fit into recesses shown in cam 18. As dog clutch 17 is rotated by operation of the rotation of key 27 in lock 16, cam 18 is also rotated. In this way, element 17 functions and operates as a normal dog clutch.

The engagement of flanges 23 of dog clutch 17 in their corresponding slots grooved in one of the faces of cam 18 takes place in opposition to spring 24.

The bases of triangles 5 and 6, which meet or even overlap at operating means 11, are cut out with a notch and folded back so as to marry the form of cam 18. The control unit for triangles 5 and 6 is fastened to door 1 by means of plates 25 and bolts 26.

To move triangles 5 and 6 into the previously described locking position by use of the second mens for driving the cam, key 27 is inserted into lock 16 and turned. This pushes dog clutch 17 back into the housings of cam 18 and makes handwheel 15 integral with the cam. The handwheel is rotated, which causes the cam to rotate. Rotation of the cam and, consequently, spirals 21 which are grooved in it, brings about diametrical movement of fingers 22 and, as a result, the moving apart of triangles 5 and 6. The reverse operation determines the bringing together of triangles 5 and 6. Rotating key 27 after one turn, back one turn disengages dog clutch 23 from cam 18 and separates handwheel 15, which becomes idle.

Figure 8:
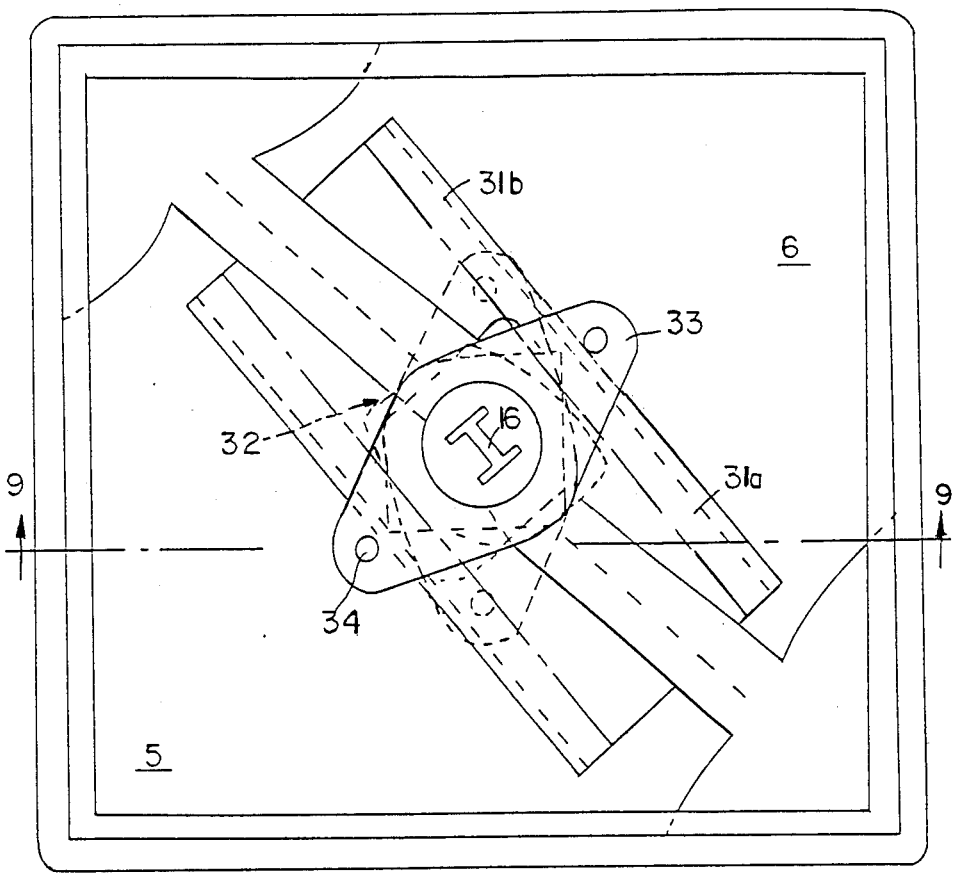
FIGS. 8 and 9 show, in elevation and in section, respectively, a safe whose door is equipped with a locking device according to the invention.
Figure 9:
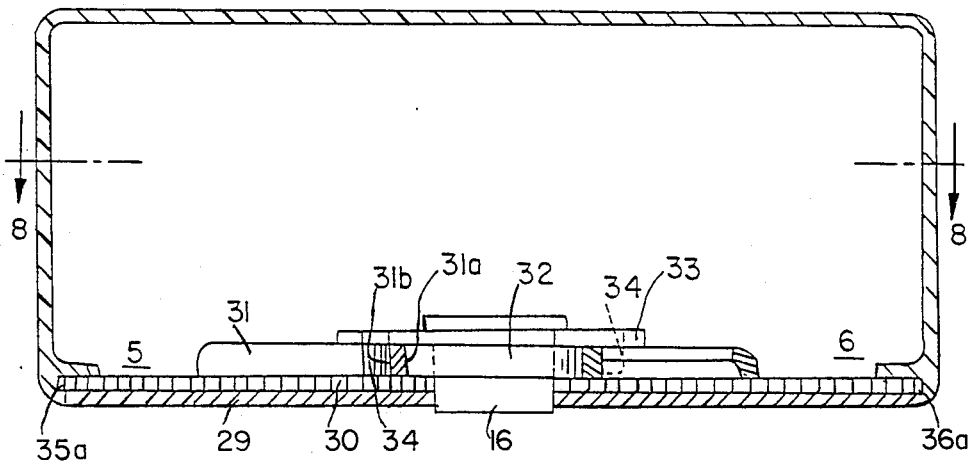

In the assembly represented by FIGS. 8 and 9, the locking device according to the invention is applied to a portable safe door.

The door equipping the safe is made up of outer metal panel 29 lined with inner metal plate 30. Flanged channel section 31 is welded, by the edge of its flanges, onto metal plate 30. Channel section 31 longitudinally overlays imaginary diagonal line 4 of plate 30 longitudinally, and extends approximately half the length of plate 30, and is distributed on both sides of its central axis. Locking plate 30 and section 31 are cut into two parts along diagonal 4, forming two equal and opposed triangles 5 and 6 placed edge to edge. The triangles are extended and retracted along diagonally by means of an operating system comprising cam 32 controlled by lock 16. The profile of cam 32 is supported on interiors 31*a* of the flanges of channel section 31. Plate 33 is also engaged to lock 16, and is supported on exteriors 31*b* of the flanges of channel section 31 by extensions 34. Turning the lock in one direction causes rotation of cam 32 rotation of cam 32 moves the flanges of the channel apart, thereby also forcing triangles 5 and 6, each of which is integral with its corresponding segment of section 31, to move apart. This movement has the effect of locking the door, since the sides of the triangles enter into the corresponding slots 35*a*–36*a*. Turning the lock in the opposite direction brings about unlocking of the door to unlock, since the triangles are retracted from the slots until they are edge to edge. Extensions 34 of plate 33 ensure that the flanges of channel section 31, and consequently the triangles 5 and 6, are pinched together when the triangles are fully retracted.

If the operating system is neutralized, at least one of the triangles, in particular triangle 6, which is anchored in floor, moves automatically under the action of its own weight and/or return springs and penetrates into the slot 8*a* of the threshold and into the slot 10*a* of the frame stile, thus locking at least two sides of the door. This device therefore offers absolute security even in the case of break-in.

It is further understood that modifications can be made to the device that has just been described, in particular by the substitution of equivalent technical means without stepping outside the framework of the present invention.

I claim:

1. A closure and locking system comprising:

(a) a fixed frame having opposed stile members, a top rail member, and a threshold member interconnecting the stile members, each member having an aligned slot which form a continuous recess in the frame;

(b) a closure for the frame movably mounted on the frame;

(c) a locking device for locking the closure in a closed position, said locking device comprising only two substantially identical, opposed, solid and rigid triangular locking elements reciprocatingly mounted on the closure to project in opposite directions along a first imaginary diagonal line within the closure between an unlocked and a locked position, wherein when said triangular locking elements are in said unlocked position, said triangular locking elements retract along said first imaginary diagonal line until their entire outer edges are substantially flush with the entire outer edges of said closure and the inner edges of the triangular locking elements come to rest substantially adjacent to one another along a second imaginary diagonal line within the closure, said first and second imaginary diagonal lines crossing each other in substantially a central point of said closure, and wherein when said triangular locking elements are in said locked position, said triangular locking elements project in opposite directions along said first imaginary diagonal line until the outer edges of one of said triangular locking elements enter the slots of one of said stile members and said top rail member, and the outer edges of the other of said triangular locking elements enter the slots of the other stile member and said threshold member;

(d) means for projecting and retracting said triangular locking elements; and (e) means for guiding the movement of said triangular locking elements.

2. The system of claim 1 wherein said triangular locking elements are composed of a material selected from the group consisting of metal and metal alloy.

3. The system of claim 1 wherein said closure comprises two panels defining an open space, and said triangular locking elements are positioned in said open space.

4. The system of claim 3 wherein the means for guiding the movement of each of said triangular locking elements comprises at least one cleat secured to each of said panels through at least one aperture in each of said triangular locking elements, said at least one aperture through which said at least one cleat passes having an oblong shape.

5. The system of claim 3 wherein the means for guiding the movement of each of said triangular locking elements comprises at least one cleat secured to each of said panels through at least one aperture in each of said triangular locking elements, said at least one aperture through which said at least one cleat passes having a rectangular shape.

6. The system of claim 5 wherein the means for projecting and retracting each of said triangular locking elements comprises:

(a) a circular disc-shaped cam having a spiral slot grooved on each lateral face; and (b) two fingers, each engaged with one of said triangular locking elements and with said cam at one of said spiral slots, whereby rotation of said cam in a first direction radially projects said two fingers and thereby projects said triangular locking elements along said first imaginary diagonal line, and rotation of said cam in a second, opposite direction radially retracts said two fingers and thereby retracts said triangular locking elements along said first imaginary diagonal line.

7. The system of claim 6 wherein said cam is operably associated with a hand wheel so that the cam rotates upon rotation of the hand wheel.

8. The system of claim 6 having a means for operating said cam comprising:

(a) a spring mounted in the cam;

(b) a dog clutch engageably associated with said cam to rotate said cam in opposition to said spring;

(c) a rotatable hand wheel;

(d) a lock mounted in said hand wheel and operably associated with said dog clutch; and (e) a key for insertion in said lock and subsequent rotation in said lock to engage said dog clutch with said cam, thereby making said cam integral with said hand wheel so that said cam rotates upon rotation of said hand wheel.

9. The system of claim 1 wherein the means for reciprocating said triangular locking elements comprises:

(a) two flanged cam-support elements, each secured to one of said triangular locking elements along the edge of its flange and each approximately half the length of and aligned parallel to said second imaginary diagonal line within the opening defined by the frame, said two flanged cam-support elements forming a channel section parallel to and spanning said second imaginary diagonal line when said triangular locking elements are positioned substantially adjacent to one another along said second imaginary diagonal line;

(b) a cam supported by its profile on the interior of said flanges of said cam-support elements, said cam reciprocating said triangular locking elements by rotation in a first direction to force said flanges apart and thereby project said triangular locking elements, and by rotation in a second, opposite direction to force said flanges together and thereby retract said triangular locking elements;

(c) a rotatable pinching element supported by extensions on the exterior of said flanges of said cam-support elements, said pinching element pinching said cam-support elements together by rotation in said second direction, thereby retracting and pinching together said triangular elements; and (d) a lock for rotatingly operating said flanged cam-support elements and said pinching element.

10. The system of claim 9 wherein said triangular locking elements are composed of a material selected from the group consisting of metal and metal alloy.

* * * * *